United States Patent [19]

Bob et al.

[11] 4,149,281

[45] Apr. 17, 1979

[54] FLOATING SPA

[75] Inventors: Paul D. Bob, Huntington Beach; Leo L. Dee, Costa Mesa; Donald M. Berliner, Huntington Beach, all of Calif.

[73] Assignee: Industrial Molded Fiberglass, Santa Ana, Calif.

[21] Appl. No.: 724,726

[22] Filed: Sep. 20, 1976

[51] Int. Cl.[2] ..... A47K 3/00

[52] U.S. Cl. ..... 4/171; 4/172.15

[58] Field of Search ..... 4/171, 172.15

[56] References Cited

U.S. PATENT DOCUMENTS

| | | | |
|---|---|---|---|
| 1,752,191 | 3/1930 | Moray | 4/171 |
| 3,781,925 | 1/1974 | Curtis et al. | 4/172.15 |

*Primary Examiner*—Houston S. Bell, Jr.

[57] ABSTRACT

A pre-formed floating therapy spa for use in an existing body of water which comprises a hollow buoyant shell connected through at least one water inlet, one air inlet and one water outlet to a circulating system which provides the means for transferring water, air or mixtures thereof from an existing source into the floating spa.

33 Claims, 3 Drawing Figures

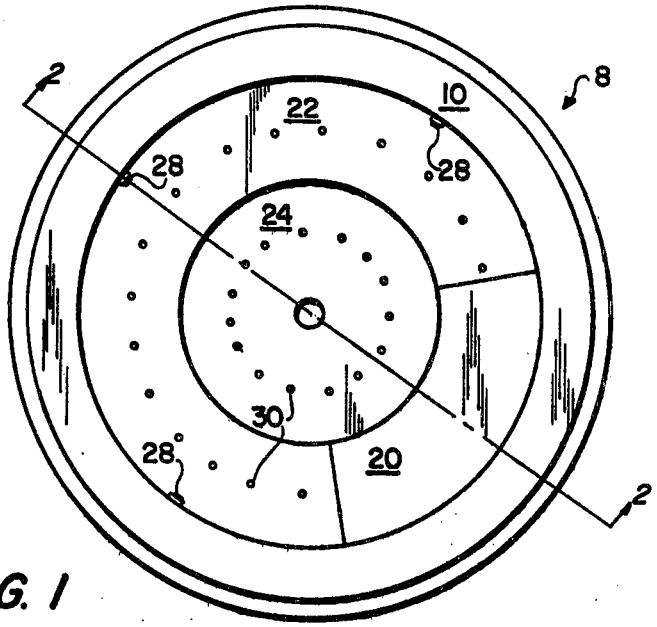
FIG. 1
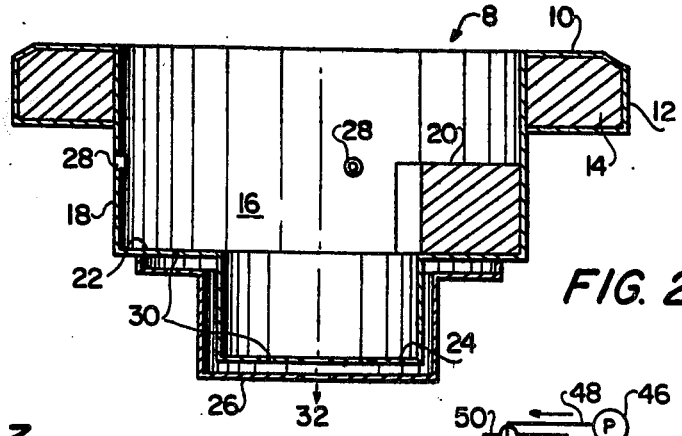
FIG. 2
FIG. 3
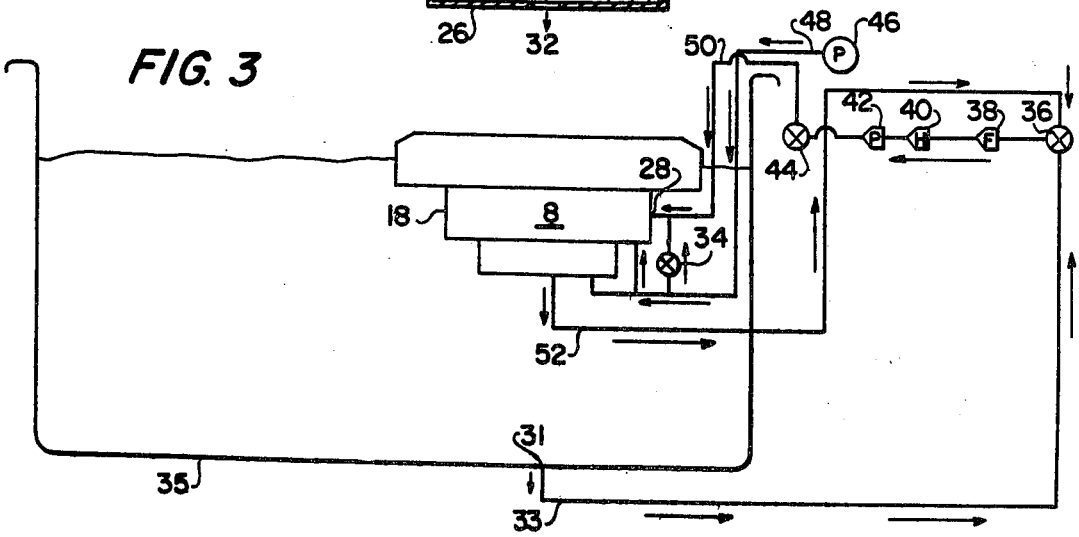

FLOATING SPA

BACKGROUND OF THE INVENTION

This invention relates to pools and more specifically to therapeutic pools or spas for use in an existing body of water.

A spa, a therapeutic pool and a whirlpool bath are basically designed to provide a therapeutic pleasurable heated massaging or rubbing action to the person or persons within the spa. This hydro massage is accomplished by circulating water from a swimming pool, lake, stream or other body of water, and/or spa through certain auxiliary pieces of equipment such as filters, heaters, pumps and the like and then back into the spa through one or more jet nozzles. Additionally, a plurality of air holes may be incorporated into the spa structure, thereby permitting air to be bubbled into the spa and providing the user with an additional massage sensation.

Prior spa systems have had various objections. For instance, many required excavating and building permits to install the spa. Others which may be used with existing swimming pools required that they be mounted along the pool exterior or, if internally mounted, that they be bolted to the pool's bond beam, coping or connected to the pool's bottom. By installing these spas with bolts or any type of connector required a large expenditure and caused permanent damage to the existing swimming pool. Also, such installation made removal of the spa from the swimming pool a major task.

SUMMARY OF THE INVENTION

Accordingly, there is provided by the present invention a floatable spa for use in an existing body of water, such as a swimming pool, lake, stream or ocean, wherein the spa comprises a hollow buoyant shell needing no mountings, and a circulating system connected through at least one inlet to said shell so as to provide a means for transferring water, or air, or mixtures thereof from an existing source into said shell, and one outlet to return the water only through the circulating system.

OBJECTS OF THE INVENTION

It is therefore an object of the present invention to provide a free floating spa, for use in existing bodies of water.

Yet a further object of the present invention is to provide a spa which connects to the circulating and/or heating system of an existing pool.

Still a further object of the present invention is to provide a spa for use in a swimming pool which does not require mounting or bolting to the side or bottom of the existing pool.

Another object of the present invention is to provide a floatable spa which will in no way damage an existing pool or pool deck.

Still another object of the present invention is to provide a floatable spa which is self-skimable, thereby automatically washing out body oils and miscellaneous debris.

Yet another object of the present invention is to provide a spa in which the water level may easily be raised or lowered.

Another object of the present invention is to provide a low cost therapeutic massage bath for use in an existing pool or other body of water.

Yet another object of the present invention is to provide a swimming pool owner the energy-saving choice of heating only about 200 gallons of water in the floating spa rather than 25,000 to 30,000 gallons of water in the swimming pool.

Still another object of the present invention is to provide a swimming pool owner the opportunity of using his pool's circulating and/or heating system for a useful and healthful purpose in addition to its normal use.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 1 is a top view of the floatable spa.

FIG. 2 is a cross-sectional view of the floatable spa taken along line 2—2.

FIG. 3 is an in-situ diagrammatical representation of the floatable spa and the circulation system in an existing swimming pool with its present circulation system.

DESCRIPTION OF THE PREFERRED EMBODIMENTS

Like reference characters designate like elements throughout the several views.

Referring now to FIGS. 1 and 2, there is shown the floatable spa 8 sufficiently large to hold at least one person and as many as 8 people. The spa has a collar 10 which acts as both the means for stabilizing the spa 8 within the existing body of water, and has the means for making the spa 8 buoyant. Although any material which is less dense than water can function in this manner, it is preferred that the collar 10 be made of a tough outer skin 12 and a low density interior material 14 capable of supporting up to about 2000 pounds of weight (excluding the water within the spa). The outer skin 12 is most preferably fiberglass or other polymeric material, while the low density interior material 14 may be either a gas, a low density liquid or a low density solid. If it is a gaseous material it should be an inert material such as air, nitrogen or carbon dioxide. However, a low density foam is preferred, and low density polyurethane foam is most preferred.

Depending from the collar is a rigid, semi-rigid, or flexible body 16 in the shape of a shell or a tub-like structure. It is preferred that the body 16 be made of a rigid material. The material may additionally be buoyant or nonbuoyant. This rigid body 16 may be detachable from the collar 10 although in the preferred configuration the collar 10 and rigid body 16 are integrally connected. The rigid body 16 is basically made up of side-walls 18, upper seating level 20, lower seating level 22, bottom or footwell 24 and a hollow substructure 26. Although two seating levels are preferred, any number of seating or reclining levels may actually be incorporated into the rigid body 16 and if desired, the seating levels may be entirely eliminated. The only limitations on seating is the size of the floatable spa 8 and desirability of its seating capacity. It should also be noted that the upper seating level 20 serves as a step to facilitate ease of entry and exit.

Incorporated into the rigid body 16 and through the sidewalls 18 is at least one water or water-air inlet 28. Although one inlet 28 would serve to circulate water or the water solution within the rigid body 16, a plurality of inlets 28 would be preferred, and three inlets would be most preferred. Any type of inlet will work to a greater or lesser degree, however, a nozzled inlet would be preferred, and a pivotally mounted nozzled inlet would be most preferred. It should be recognized that this kind of nozzled inlet 28 will provide the therapeutic massage which helps make the floating spa 8 such a desirable item. The floatable spa 8 may be further enhanced by incorporation into the lower seating level 22 and into the foot well 24 a plurality of holes 30 through which air may be bubbled. Although holes 30 are preferred in the foot well 24 and the lower seating level 22 they may be incorporated throughout the entire body 16 or they may be totally eliminated if desired. Finally, drain 32 located in the foot well 24 provides the major means for discharging excess water from the floatable spa 8 and returning it to the circulating system.

It should be recognized that various optional items may be incorporated into the floatable spa 8. These iuclude, but are not limited to, a door in the side-wall 18 to facilitate entrance and exit, glass holders, umbrella stands, boat-type, bumpers and cleats, raft covers, and the like.

Although the floatable spa may be constructed out of almost any buoyant material or any material which may be made buoyant by addition of a floatation collar, materials such as plexiglass, fiberglass, wood, metal, rubber and almost any other polymeric material may be used. However, the most preferred material due to its ease of maintainability, durability, mode of manufacture, and cost is fiberglass reinforced plastic. In addition, the fiberglass may be prepared with a non-skid surface thereby enhancing the safety aspect of the spa.

Turning now to FIG. 3 there is shown the floatable spa 8, in an existing swimming pool 35, and a circulating system. The circulating system is basically made up of a water circulating system and an optional air circulating system. In the preferred configuration, the water and air circulating systems are connected together through an air equalizer valve 34. In operation the water circulating system drains water out of the pool through drain 31 and through return line 33, and out of the spa drain 32 through return line 52 to the water return diversion valve 36. This water then flows through filter 38, heater 40, circulating pump 42, water outlet diversion valve 44 and back into the spa 8 through the water and air jet nozzles 28. Concurrently, the optional air circulating system can pump air with air pump 46 from the surroundings through the air inlet line 48 where it is split, part entering the spa 8 through the sub-structure 26 and the air holes 30 in the spa's bottom 24 and seat area 22, while the remaining portion of the air is aspirated through the air equalizer valve 34 and mixed with the water in the water inlet line 50 before the airated mixture is pumped into the spa 8 through the water and air jet nozzles 28. It should be realized that although this is the normal operating means for the circulation system, modifications may be made and units interchanged as needed. Furthermore, it should be realized that although rigid or flexible water and air lines may be used, the use of flexible lines within the pool 34, or body of water, makes the spa 8 entirely free floating. Also, to help reduce cost the air circulating system may be eliminated and the spa may be operated solely with the water circulation system.

During normal use, the spa 8 is filled with water or a pool type water solution so that the water within the spa 8 is at the same level as that in the existing body of water. Filling in this manner makes the top of the collar 10 ride about 4 to 5 inches above the exterior water level and gives the spa approximately a three foot draft thereby making it virtually untippable and unsinkable. It should be noted that the spa 8 may be over filled without any undesirable effects. In fact, by closing the return diversion valve 36 so that no water is drained from the spa 8, the spa 8 may be completely filled forcing the water out over the collar 10 and thereby skimming the spa 8, a very desirable feature. Similarly, the spa 8 may be drained by closing the water outlet diversion valve 44 so no water is permitted to enter the spa 8. This makes the spa 8 ride high in the water and facilitates spa removal.

Although, generally not as desirable as the aforementioned spa configuration, the spa 8 may be made from or cast with a low density shell 16 thereby eliminating the need for a collar 10, this however does reduce spa stability.

Thus, it is apparent that there is provided by this invention a floatable spa for use in an existing body of water.

It is to be understood that what has been described is merely illustrative of the principles of the invention and that numerous arrangements in accordance with this invention may be devised by one skilled in the art without departing from the spirit and scope thereof.

What is new and desired to be sured by Letters Patent of the United States is:

1. A floatable spa for use in a swimming pool comprising:

a hollow buoyant shell acting as a floating receptable for circulating water and for at least one person; and a circulating system connected through at least one nozzled inlet and one outlet to said shell so as to provide a means for transferring water or water and air mixtures from an existing source into said shell.

2. The floatable spa of claim 1 wherein said hollow buoyant shell, comprises:

a low density collar, for adding buoyancy and stability to said shell; and a rigid tub-like body depending therefrom.

3. The floatable spa of claim 2 wherein said low density collar comprises a tough outer skin and a low density interior.

4. The floatable spa of claim 3 wherein said tough outer skin is fiberglass and said low density interior is a foam.

5. The floatable spa of claim 4 wherein said foam is polyurethane foam.

6. The floatable spa of claim 3 wherein said low density material is an inert gaseous material selected from the group consisting of air, nitrogen, carbon dioxide and mixtures thereof.

7. The floatable spa of claim 2 wherein said rigid body is made from a material selected from the group consisting of a metal, a wood, a polymeric material and fiberglass.

8. The floatable spa of claim 7 wherein said rigid material is fiberglass.

9. The floatable spa of claim 2 wherein said rigid tub-like body comprises side-walls, a bottom and at least one interior seating level.

10. The floatable spa of claim 9 wherein there is an upper and a lower seating level.

11. The floatable spa of claim 10 wherein said bottom and said lower seating level have a plurality of holes through which air may be bubbled.

12. The floatable spa of claim 9 wherein said rigid body has a substructure connected to said rigid body so as to form a gap between said substructure and said bottom as well as between said sub-structure and said seating level.

13. The floatable spa of claim 12 wherein said gap is an air gap.

14. The floatable spa of claim 9 wherein a plurality of nozzled inlets are connected through said side-walls of said tube-like structure to facilitate circulation of the water, air or mixtures thereof within said shell.

15. The floatable spa of claim 14 wherein said nozzles are pivotally mounted into said side-walls.

16. The floatable spa of claim 1 wherein said circulating system, comprises:

a water circulating system having a liquid return diversion valve, a filter, a heater, a circulating pump and a water outlet diversion valve all connected in series to a plurality of spa inlets through which water or an aqueous solution is introduced into said floatable spa; and an air circulating system having an air pump, at least one air inlet, and an air equalizer valve and wherein said air circulating system is connected to said water circulating system through said air equalizer valve, and to said floatable spa through the air gap and said air inlets at the lower portion of said hollow buoyant shell.

17. A floatable spa for use in an existing swimming pool or other body of water, comprising:

a hollow buoyant tub-like device including:

a low density buoyant collar;

a fiberglass reinforced plastic body depending from said collar having side-walls, a bottom, an upper and a lower seating level, and a sub-structure connected to said bottom and said seating areas so as to form an air gap;

a plurality of nozzle inlets in said side walls for introducing a water or an air-water solution into said floatable spa; and a plurality of air holes incorporated into said bottom and said lower seating level of said spa and through which air is bubbled into said floatable spa; and a circulation system, including:

a water circulating system having a liquid return diversion valve, a filter, a heater, a circulating pump and a water outlet diversion valve all connected in series, a plurality of spa nozzle inlets through which water or an aqueous solution is introduced into said floatable spa and a drain whereby the water is returned to the liquid return diversion valve; and an air circulating system having an air pump, at least one air inlet and an air equalizer valve and wherein, said air circulating system is connected to said water circulating system through said air equalizer valve and to said floatable spa through said air gap and said air inlets at the lower portion of said hollow buoyant shell.

18. A floatable spa for use in a swimming pool comprising:

a hollow buoyant shell, acting as a floating receptable for circulating water and air and for at least one person; and a circulating system connected through at least one nozzled inlet and one outlet to said shell so as to provide a means for transferring water and air mixtures from an existing source into said shell.

19. The floatable spa of claim 18 wherein said hollow buoyant shell, comprises:

a low density collar, for adding buoyancy and stability to said shell; and a rigid tube-like body depending therefrom.

20. The floatable spa of claim 19 wherein said low density collar comprises a tough outer skin and a low density interior.

21. The floatable spa of claim 20 wherein said tough outer skin is fiberglass and said low density interior is a foam.

22. The floatable spa of claim 21 wherein said foam is polyurethane foam.

23. The floatable spa of claim 20 wherein said low density material is an inert gaseous material selected from the group consisting of air, nitrogen, carbon dioxide and mixtures thereof.

24. The floatable spa of claim 19 wherein said rigid body is made from a material selected from the group consisting of a metal, a wood, a polymeric material and fiberglass.

25. The floatable spa of claim 24 wherein said rigid material is fiberglass.

26. The floatable spa of claim 19 wherein said rigid tub-like body comprises side-walls, a bottom and at least one interior seating level.

27. The floatable spa of claim 26 wherein there is an upper and a lower seating level.

28. The floatable spa of claim 27 wherein said bottom and said lower seating level have a plurality of holes through which air may be bubbled.

29. The floatable spa of claim 26 wherein said rigid body has a substructure connected to said rigid body so as to form a gap between said substructure and said bottom as well as between said substructure and said seating level.

30. The floatable spa of claim 29 wherein said gap is an air gap.

31. The floatable spa of claim 26 wherein a plurality of nozzled inlets are connected through said side-walls of said tub-like structure to facilitate circulation of the water and air within said shell.

32. The floatable spa of claim 31 wherein said nozzles are pivotally mounted into said side-walls.

33. The floatable spa of claim 18 wherein said circulating system, comprises:

a water circulating system having a liquid return diversion valve, a filter, a heater, a circulating pump and a water outlet diversion valve all connected in series to a plurality of spa inlets through which water or an aqueous solution is introduced into said floatable spa, and an air circulating system having an air pump, at least one air inlet, and an air equalizer valve and wherein said air circulating system is connected to said water circulating system through said air equalizer valve, and to said floatable spa through the air gap and said air inlets at the lower portion of said hollow buoyant shell.

* * * * *